United States Patent [19]

Murase

[11] Patent Number: 4,467,534

[45] Date of Patent: Aug. 28, 1984

[54] DRYING APPARATUS

[75] Inventor: Kazuyoshi Murase, Nagoya, Japan

[73] Assignee: Tokyo Shibaura Denki Kabushiki Kaisha, Kawasaki, Japan

[21] Appl. No.: 354,532

[22] Filed: Mar. 4, 1982

[30] Foreign Application Priority Data

Mar. 31, 1981 [JP] Japan ..... 56-48812

[51] Int. Cl.[3] ..... F26B 11/02

[52] U.S. Cl. ..... 34/82; 34/133; 34/140

[58] Field of Search ..... 34/82, 133, 140; 432/105, 107

[56] References Cited

U.S. PATENT DOCUMENTS

| | | | |
|---|---|---|---|
| 2,807,889 | 10/1957 | Dunkelman | 34/133 |
| 2,941,309 | 6/1960 | Cobb | 34/133 |
| 3,378,934 | 4/1968 | Erickson | 34/82 |

FOREIGN PATENT DOCUMENTS

| | | | |
|---|---|---|---|
| 1221343 | 3/1968 | United Kingdom | 34/133 |
| 1226951 | 3/1971 | United Kingdom . | |

*Primary Examiner*—Larry I. Schwartz
*Assistant Examiner*—David W. Westphal
*Attorney, Agent, or Firm*—Schwartz, Jeffery, Schwaab, Mack, Blumenthal & Koch

[57] ABSTRACT

A drying apparatus includes a cabinet, an open-ended drum having a horizontal axis disposed in the cabinet, support means for rotatably supporting the drum, an opening with a door disposed in the front panel and faced toward the open end of the drum, an air inlet port provided in the cabinet, an exhaust port provided on one side of the door on the front panel and communicating with the interior of the drum, drive means for rotating the drum in the direction in which the lower portion of the drum moves away from the exhaust port, and means for supplying heated air into the interior of the drum.

15 Claims, 3 Drawing Figures

DRYING APPARATUS

BACKGROUND OF THE INVENTION

The present invention relates to a drying apparatus and more particularly to an improvement of a drying apparatus having an open-ended drum supported rotatably about a horizontal axis.

In conventional types of drying apparatus, an air inlet port having a filter is provided, for instance, in the front part or panel of the cabinet, while an exhaust port having a filter is provided at the central portion of the rear wall of the open-ended rotatable drum. The filter in the air inlet port catches any dust in the air which is introduced through the air inlet port, and the filter in the exhaust port catches any lint contained in the exhaust air. With such a construction, however, although the inspection and cleaning of the air inlet portion can be carried out easily, inspection and cleaning of the filter in the exhaust port are difficult, because in its rearward position of the drum it is hardly accessible.

Recently, a construction has been proposed (it is not a part of the prior art) wherein the air inlet port with its filter and the exhaust port with its filter are both provided in the front part or panel of the cabinet at a position adjacent to the door on both sides thereof for facilitating the inspection and cleaning operation. In this case, the air inlet port communicates with an air path defined between the side wall of the cabinet and a peripheral surface of the drum, while the exhaust port communicates with the interior of the same drum. It is desirable from the viewpoint of operational convenience that the opening for placing materials or clothes into the drum and taking them out of the drum is disposed at the front portion or panel of the cabinet.

Therefore, the exhaust port is positioned on one side of the door on the front panel in such a way as to be facing the peripheral area of the interior of the drum. On the other hand, even though clothes or materials to be dried are piled up adjacent to the lower part of the inner peripheral wall of the drum when the latter is not rotating, those on the bottom of the inner peripheral wall are carried along with the drum and are lifted to the upper part of the drum during operating or rotating of the drum, and they then separate from the inner surface of the drum to roll down or fall downwardly under the influence of gravity.

Thus, materials to be dried are tumbling within the interior of the drum into which hot air is being supplied, and then these materials are rapidly deprived of water.

On observing the distribution of materials in the drum during rotation of the latter, the distribution of materials is dense in that half or side of the interior of the drum to which materials at the lower port on the inner surface are carried, and the distribution of materials in the other half or side of the drum is sparse, since materials carried to the upper part in the interior of the drum drop downwardly before reaching the top part in the drum. Assuming here that the exhaust port is provided at a position facing the region where materials to be dried are piled up densely, the flow resistance against air becomes impractically large so as to reduce the rate of flow of hot air flowing through the materials to be dried, resulting in a lowered drying efficiency.

As a result of this construction, a desired amount of supplied hot air cannot be attained, and this also increases the tendency of the heater which produces the hot air to overheat and also undesirably shortens the life of this heater. In addition, it is necessary to provide a larger hot air supply capacity in order to get a large enough amount of hot air.

SUMMARY OF THE INVENTION

Therefore, it is an object of the present invention to provide a novel and improved drying apparatus which has an open-ended drum supported rotatably about a horizontal axis.

It is another object of the invention to provide such a drying apparatus in which an exhaust port is provided on its front panel.

It is another object of the invention to provide a novel and thermally efficient drying apparatus in which the drum is rotated in the direction in which the lower portion of the drum moves away from the exhaust port which is provided on its front panel.

In accomplishing the foregoing objects, there has been provided according to the present invention a drying apparatus comprising a cabinet having a front panel and side walls, an open-ended drum having a horizontal axis disposed in the cabinet, support means for rotatably supporting the drum, an opening disposed in the front panel and facing the open-end of the drum for loading and unloading the drum, a door operable for opening and closing the opening, an air inlet port having an induction opening provided in a portion of the cabinet, an exhaust port having an exhaust opening provided on the outside of the front panel and communicating with the interior of the drum, drive means for rotating the drum in a direction in which the lower portion of the drum moves away from the exhaust port, and means for supplying hot air into the interior of the drum housed in the cabinet.

Other objects, features and attendant advantages of the invention will become readily apparent as the apparatus becomes better understood by reference to the following detailed description of preferred embodiments, when considered in connection with the accompanying drawings.

BRIEF DESCRIPTION OF THE DRAWINGS

In the drawings, forming a part hereof, in which like reference characters denote like parts in the various views.

DETAILED DESCRIPTION OF PREFERRED EMBODIMENTS

Figure 3:
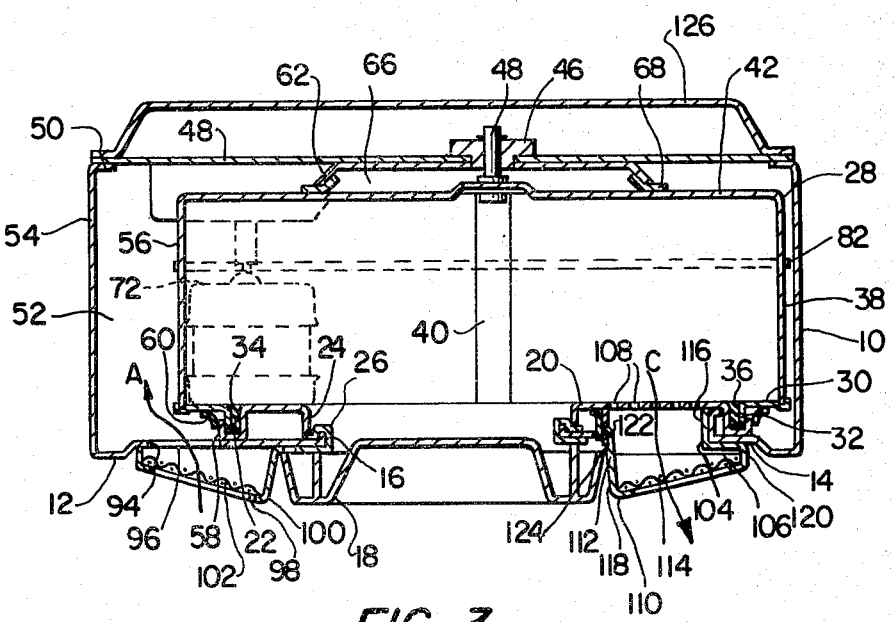
FIG. 3 is a horizontal cross-sectional view taken generally along the line III—III in FIG. 1.

Now there will be described a preferred embodiment of the invention according to FIGS. 1 through 3.

Numeral 10 designates a cabinet having a front panel 12 formed with a horizontally elongated rectangular recessed portion 14 at the center. An opening 16 of a rectangular configuration is provided through a central part of the recessed portion 14. A door 18 is hingedly attached to the front panel 12 and is horizontally swingable to open and close the opening 16. A drum supporting plate 20 is fixedly secured to the inside surface of the front panel 12 along the periphery of the opening 16, and has a drum supporting portion 22 of a short cylindrical configuration at the periphery. An opening 24 of the drum supporting plate 20 is placed in alignment with the opening 16 through a seal member 26 interposed therebetween.

A substantially cylindrical drum or an open-ended drum 28 is provided with a front annular plate 30 having a short cylindrical projection 32 with a forward bearing portion 34 in its inner periphery. The drum 28 is supported via the projection 32 by the outer periphery of the drum supporting portion 22 through a bearing member 36, best seen in FIG. 2. The drum 28 is provided with a peripheral wall 38 having a plurality of, for example, three baffle plates 40 projecting radially inwardly and extended in parallel with the axis of rotation of the drum on its inner peripheral surface.

The drum 28 is further provided with a closed (but not in the sense to exclude apertures therethrough) rear end wall 42 having a horizontal shaft 44 projecting rearwardly from the center of the end wall 42. The shaft 44 is supported freely rotatably by a bearing 46 secured to a drum supporting frame 48, which in turn is secured to the rear portion 50 of the cabinet 10 in a horizontally bridging manner. An air path 52 is defined between the side wall 54 of the cabinet 10 and the peripheral surface 56 of the drum 28 (FIG. 3). A rising portion 58 having an annular shape is formed by bending out of the drum supporting plate 20 in a manner surrounding the drum supporting portion 22. A seal member 60 is attached to the rising portion 58 so that one end of the seal member 60 slidingly contacts with the front surface of the annular plate 30 of the drum 28.

An air distributing member 62 of a circular disk shape having a number of holes 64 is secured at the rear of the drum to the drum supporting frame 48 in order to form an air distributing space 66 surrounding the shaft 44. A seal 68 provided on the outer periphery of the member 62 is brought into sliding contact with the rear end wall 42 of the drum 28. A number of through holes 70 are provided through the rear end wall 42 for communicating the interior of the drum 28 with the air distributing space 66.

An electric motor 72, as the drive means for rotating the drum 28, is secured to top wall 74 of the cabinet 10 at an upper-left position, preferably in the corner of the cabinet 10. The motor 72 is directly coupled to an extension shaft 76 having a portion operable as a pulley 78. The motor 72 is operated to rotate the drum 28 in the clockwise direction as viewed from the front side, as indicated by the arrow X in FIG. 1. A fan 80 is directly coupled to one end of the extension shaft 76. A belt 82 is extended around the pulley portion 78 and around the periphery of the drum 28, and a tension pulley 84 applies a tension to the belt 82. Reference numeral 86 designates a fan casing which covers the fan 80. A duct 88 connected with the delivering part of the fan casing 86 extends to the rear side of the air distributing member 62. The duct 88 has a number of holes 90 corresponding to the holes 64 in the air distributing member 62. Within the duct 88, there is provided an electric heater 92 to heat air delivered from the fan 80, the fan 80 and the heater 92 constituting in combination a hot air producing means. A cover plate 126 closes the rear side of the cabinet 10.

An induction opening 94 of an air inlet 96 is provided in the recessed portion 14 on the left side of the door 18. The induction opening 94 is located outwardly of the rising portion 58 of the drum supporting plate 20 and communicates with the air path 52 in the interior of the cabinet 10. An induction filter portion 98 provided with a filter frame 100 of a rectangular shape and a filter member 102 is mounted in the recessed portion 14 to cover the front end of the induction opening 94.

An exhaust opening 104 of an exhaust port 106 is provided in the recessed portion 14 on the right side of the door 18. The exhaust opening 104 is located internally of the drum supporting plate 20. A number of ventilation holes 108 acting as air exhausting holes are provided through the drum supporting plate 20 at a portion opposite to the exhaust opening 104, so that the latter is in communication through the holes 108 with the internal space or the interior of the drum 28.

An exhaust filter portion 110 provided with a filter frame 112 and an exhaust filter member 114 is mounted in the recessed portion 14 to fit the filter frame 112 into the exhaust opening 104. The filter frame 112 is provided with a sleeve portion 116 to be fitted into the exhaust opening 104, and the front frame portion 118 having the exhaust filter member 114 is connected with the sleeve portion 116 through a thin integral hinge portion 120 so as to be openable with respect to the exhaust opening 104. A clamp member 122 projecting from the edge of the front frame portion 118 is detachably inserted into a hole 124 provided in the sleeve portion 116 to hold the front frame portion closed.

The operation of the illustrated embodiment of the present invention will now be described:

With materials to be dried put into the drum 28 through the opening 16, a start switch (not shown) is operated after a timer switch (not shown) is set.

Figure 1:
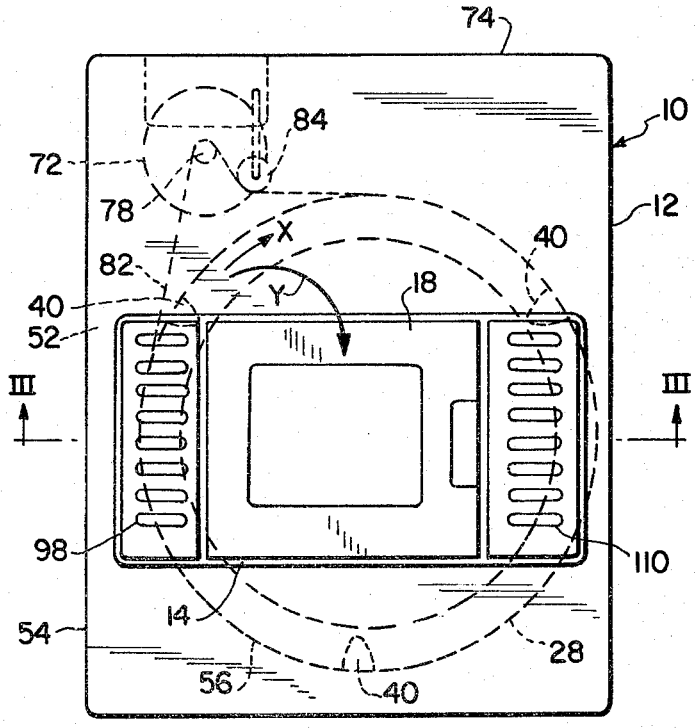
FIG. 1 is a front view of a drying apparatus according to a preferred embodiment of the invention showing the drum and drive assembly in broken lines.
Figure 2:
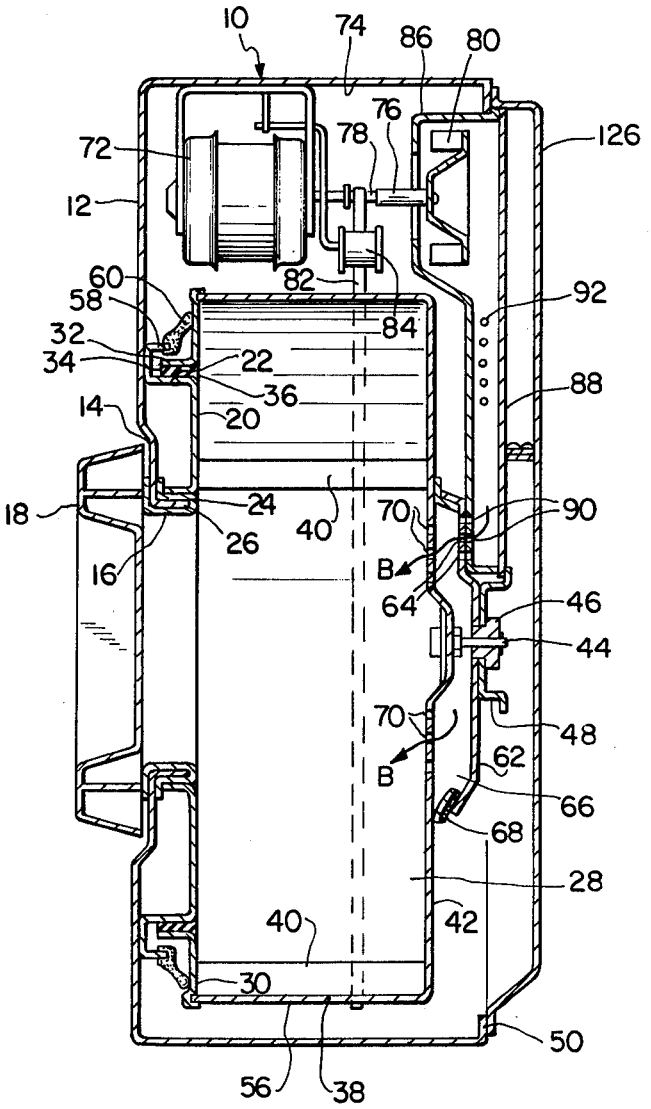
FIG. 2 is a vertical cross-sectional view, taken from the right hand side in FIG. 1, of the drying apparatus according to the invention.

Upon energization of the electric motor 72 and the electric heater 92, the fan 80 rotates, and the belt 82 drives the drum in the direction as indicated by the arrow X in FIG. 1, namely, in the direction in which the lower portion of the drum 28 moves away from the exhaust port 106 or to the left in FIG. 1. Heater 92 starts to generate heat. Air outside of the drying apparatus is inducted through the induction filter portion 98 and the induction opening 94 into the cabinet 10. Air thus entering the cabinet 10 flows through the left portion along the periphery of the drum 28, i.e., through the air path 52, as indicated by the arrow A in FIG. 3. It then enters the fan casing 86 and next the duct 88 to be heated by the heater 92. Hot air then flows, as shown in FIG. 2 by the arrow B, through holes 90 and 64 into the air distributing space 66 and then through the holes 70 into the drum 28, which is now rotating. In the drum 28, hot air deprives materials to be dried of water, and the water-laden hot air is then passed through ventilation holes 108, the exhaust opening 104 and the exhaust filter portion 110 to the outside of the cabinet 10, as shown in FIG. 3 by the arrow C. The drying operation of the drying apparatus is thus accomplished.

While the drum 28 rotates in the direction as indicated by the arrow X, materials to be dried on the lower portion of the inner surface of the drum 28 are carried by the baffle plate 40 so as to be lifted with rotation of the drum 28 to its upper part, and they then separate from the inner surface of the drum 28 to roll down, i.e., drop downwardly through the central portion of the drum 28 under the influence of gravity, as indicated by the arrow Y in FIG. 1. Thus, materials in the drum 28 are tumbling in the interior of the drum 28 so as to be constantly separated from each other. Hot air entering through the holes 70 in the center of the rear end wall of the drum 28 is exposed to each piece of the materials and then passes through ventilation holes 108. Since materials carried to the upper part in the drum 28 drop downwardly before or immediately after reaching the top part in the drum 28, the distribution of materials being dried in the right side of the interior of the drum 28 is sparse, whereas that in the left side of the interior of the drum 28 is dense. With the exhaust opening 104 of the exhaust port 106 being positioned on the right side of the interior of the drum 28, water-laden hot air, after contacting with materials to be dried, is exhausted sufficiently through the exhaust port 106.

Therefore, the stacks of materials to be dried do not impart a large resistance to the flow of hot air which is introduced into the drum 28 to be led to the exhaust openings 108.

In other words, drying efficiency will be improved because the amount of hot air blowing against the materials to be dried is sufficient to be distributed over the entire area of the materials. At the same time, the tendency of overheating of the heater 92 is suppressed by the increased flow rate of air.

Furthermore, the reduced flow resistance against the air through the drum 28 permits a reduction of the size of the fan 80 and, accordingly, a reduction in the capacity for the motor 72.

While in the above-mentioned embodiment, the exhaust port 106 is positioned at the right side of the door 18 and the drum 28 rotates clockwise, the drum 28 could equally as well be rotated counterclockwise by the drive means in the case of positioning the exhaust port 106 at the left side of the door 18 on the front panel 12.

The illustrated embodiments should not be considered to be restrictive, but rather, various changes may be made without departing from the scope of the invention. The flow of a sufficient amount of air can prevent the heater from overheating and thereby extend its lifetime. The inner surface of the drum supporting plate 20 acts as a fixed wall in opposition to the rear end wall 42 of the drum 28 to prevent materials in the drum 28 from dropping out of the interior of the drum 28 during the drying operation.

During the operation, any dust contained in the air introduced through the induction opening 94 is caught by the induction filter portion 98, forming a deposit on the front surface of the filter member 102. On the other hand, any lint contained in the exhaust air is caught by the exhaust filter member 114, to be deposited on the rear surface thereof.

Since the induction filter portion 98 and the exhaust filter portion 110 are provided on the front panel 12 of the cabinet 10, at positions on both sides of the door 18 located at the center of the front panel 12, it is made possible to gain access to these filter portions 98 and 110 from the front side of the cabinet 10. Therefore the inspection of the induction filter portion 98 and the exhaust filter portion 110 to see if they are clogged by dust or lint as well as the cleaning of the filter members 102 and 114 are greatly facilitated. To clean the filter member 114, the exhaust filter portion 110 is opened by releasing its clamp member 122 from the hole 124 of the sleeve portion 116, and then the dust and lint inside the filter member 114 are removed.

According to one preferred embodiment, the electric motor 72 is provided in the corner of the cabinet 10, in the air path 52 generally opposite to the induction opening 94, and therefore the cooling effect for the motor 72 can thereby be improved.

What is claimed is:

1. A drying apparatus, comprising:

a cabinet having a front panel and side walls;

a drum having one open end and one closed end and having a horizontal axis disposed in said cabinet, said closed end having through holes;

support means for rotatably supporting said drum inside said cabinet;

an opening disposed in said front panel and facing said open end of said drum for loading and unloading said drum;

a door operable for opening and closing said opening;

an air inlet port having an induction opening provided in a portion of said cabinet;

an exhaust port having an exhaust opening provided on one side of said door on said front panel, said exhaust port being positioned in alignment with at least a portion of said open end said exhaust port also being off center relative to said drum and communicating with the interior of said drum directly through said open end such that an air flow path is defined from said air inlet port to said exhaust port through said through holes and said drum open end;

drive means, including a motor, for rotating said drum in the direction in which the lower portion of said drum moves away from said exhaust port; and means for supplying heated air into the interior of said drum housed in said cabinet.

2. A drying apparatus according to claim 1, wherein said exhaust port is positioned on the right side of said door on said front panel, and said drive means rotates said drum in the clockwise direction.

3. A drying apparatus according to claim 1, wherein said exhaust port is positioned at the left side of said door on said front panel, and said drive means rotates said drum in the counterclockwise direction.

4. A drying apparatus according to claim 1, wherein said exhaust port includes a filter for filtering exhaust air.

5. A drying apparatus according to claim 1, wherein said air inlet port includes a filter for filtering inducted air.

6. A drying apparatus according to claim 1, wherein said air inlet is positioned on the opposite side from said exhaust port with respect to said door on said front panel.

7. A drying apparatus according to claim 1, wherein said drum includes baffle means for upwardly lifting materials being dried inside of said drum.

8. A drying apparatus according to claim 7, wherein said baffle means comprises a plurality of baffle plates projecting radially inwardly from the inner peripheral surface of the drum.

9. A drying apparatus according to claim 1, wherein said drive means comprises an electric motor, a pulley driven by said electric motor and a belt extended around said pulley and around the periphery of said drum.

10. A drying apparatus according to claim 9, wherein said electric motor is disposed in one corner of said cabinet.

11. A drying apparatus according to claim 1, wherein said drum further comprises a shaft projecting rearwardly from the center of its closed wall, an annular plate provided at the open end of the drum, and a bearing portion formed at the inner periphery of said annular plate, and said supporting means comprises a bearing supported in the rear portion of said cabinet for supporting said shaft and a supporting plate attached to said front panel and having a drum supporting portion for supporting said bearing portion.

12. A drying apparatus according to claim 11, wherein said supporting plate includes holes for providing communication between said exhaust port and the interior of said drum.

13. A drying apparatus according to claim 11, wherein said supporting plate includes holes positioned directly adjacent to said exhaust opening for providing communication between said exhaust port and the interior of said drum.

14. A drying apparatus according to claim 1, wherein said means for supplying heated air to the interior of said drum comprises a fan driven by said drums. motor, a duct leading generally from said fan to the central portion of the rear end wall of said drum, an electric heater positioned in the duct, and through holes in the central portion of the end wall of said drum.

15. A drying apparatus according to claim 14, wherein said means for supplying heated air to the interior of said drum further comprises an air distributing space disposed between said through holes and said duct.

* * * * *